US010538289B1

(12) United States Patent
Cifers et al.

(10) Patent No.: US 10,538,289 B1
(45) Date of Patent: Jan. 21, 2020

(54) EXTENDABLE AND RETRACTABLE HANDLE ASSEMBLY

(71) Applicant: Luther Cifers, Amelia, VA (US)

(72) Inventors: Luther Cifers, Amelia, VA (US); Matthew Montaruli, Greenville, SC (US); Hans Nutz, Easley, SC (US)

( * ) Notice: Subject to any disclaimer, the term of this patent is extended or adjusted under 35 U.S.C. 154(b) by 0 days.

(21) Appl. No.: 16/030,513

(22) Filed: Jul. 9, 2018

Related U.S. Application Data

(60) Provisional application No. 62/530,267, filed on Jul. 9, 2017.

(51) Int. Cl.
*B63B 17/00* (2006.01)
*B63B 35/71* (2006.01)
*B63B 35/81* (2006.01)

(52) U.S. Cl.
CPC ..... *B63B 17/00* (2013.01); *B63B 35/71* (2013.01); *B63B 35/817* (2013.01)

(58) Field of Classification Search
CPC ..... B63B 17/00; B63B 35/71; B63B 35/817
See application file for complete search history.

(56) References Cited

U.S. PATENT DOCUMENTS 4,964,355 A * 10/1990 Milewski ..... B63B 21/045 114/218
5,501,168 A * 3/1996 Zachary ..... B63B 35/731 114/363
6,021,734 A * 2/2000 Sperberg ..... B63B 17/04 114/363
2013/0130578 A1* 5/2013 Friedman ..... B63B 35/7946 441/74

* cited by examiner

*Primary Examiner* — Stephen P Avila
(74) *Attorney, Agent, or Firm* — Thedford I. Hitaffer; Hitaffer & Hitaffer, PLLC

(57) ABSTRACT

An extendable and retractable handle assembly comprises a handle connected to a marine vessel or watercraft. The handle is housed within the profile of the watercraft and is further connected to the watercraft by an elastic cord. The elastic cord is connected to both the handle and the watercraft to provide tension to the handle when extended.

20 Claims, 3 Drawing Sheets

EXTENDABLE AND RETRACTABLE HANDLE ASSEMBLY

CROSS-REFERENCE TO RELATED APPLICATIONS

This application claims the benefit of U.S. Provisional Application No. 62/530,267, filed Jul. 9, 2017, the disclosure of which is incorporated herein by reference by its entirety.

BACKGROUND OF THE INVENTION

This invention relates in general to a stowable handle assembly and more particularly to an extendable and retractable handle for watercraft, most particularly for kayaks.

Handles are used in a wide range of applications and while the state of the art in marine vessels or watercraft includes a range of handle options, these handles may only be tied to the watercraft and protrude out beyond the shape of the watercraft. Other handles may be attached to the watercraft but are unable to extend when a user lifts or hauls the watercraft and then retract when lifting or hauling has been completed. These handles may also not provide sufficient clearance for users who have larger hands, as these handles must have a low profile in order to refrain from causing injury when a user enters or exits the watercraft and accidentally bumps into the handle. Moreover, the handle must remain out of the way of other features of the watercraft, such as the rudder, which is attachable to the stern (i.e., the rear) of the watercraft, particularly in an area of the hull of kayak that is shared by the handle.

There is a need for an extendable and retractable handle assembly for watercraft.

SUMMARY OF THE INVENTION

This invention relates to an extendable and retractable handle assembly comprising a handle connected to a watercraft. The handle is housed within the profile of the watercraft and is further connected to the watercraft by an elastic cord. The elastic cord is connected to both the handle and the watercraft to provide tension to the handle when extended.

The handle may be rotationally extended about pivot points or slidably extended when a user pulls on the handle. The handle is subsequently retracted back into the watercraft housing when the user releases the handle, as the elastic cord provides sufficient tension on the handle to cause it to retract.

Various advantages of this invention will become apparent to those skilled in the art from the following detailed description of the preferred embodiment, when read in light of the accompanying drawings.

BRIEF DESCRIPTION OF THE DRAWINGS

It should be noted that orientational terms used throughout this description are with reference to the orientation of the seat and component parts as presented in the accompanying drawings, which is subject to change. Therefore, orientational terms are used for semantic purposes, and do not limit the invention or its component parts in any particular way.

DETAILED DESCRIPTION OF THE PREFERRED EMBODIMENT

Figure 1:
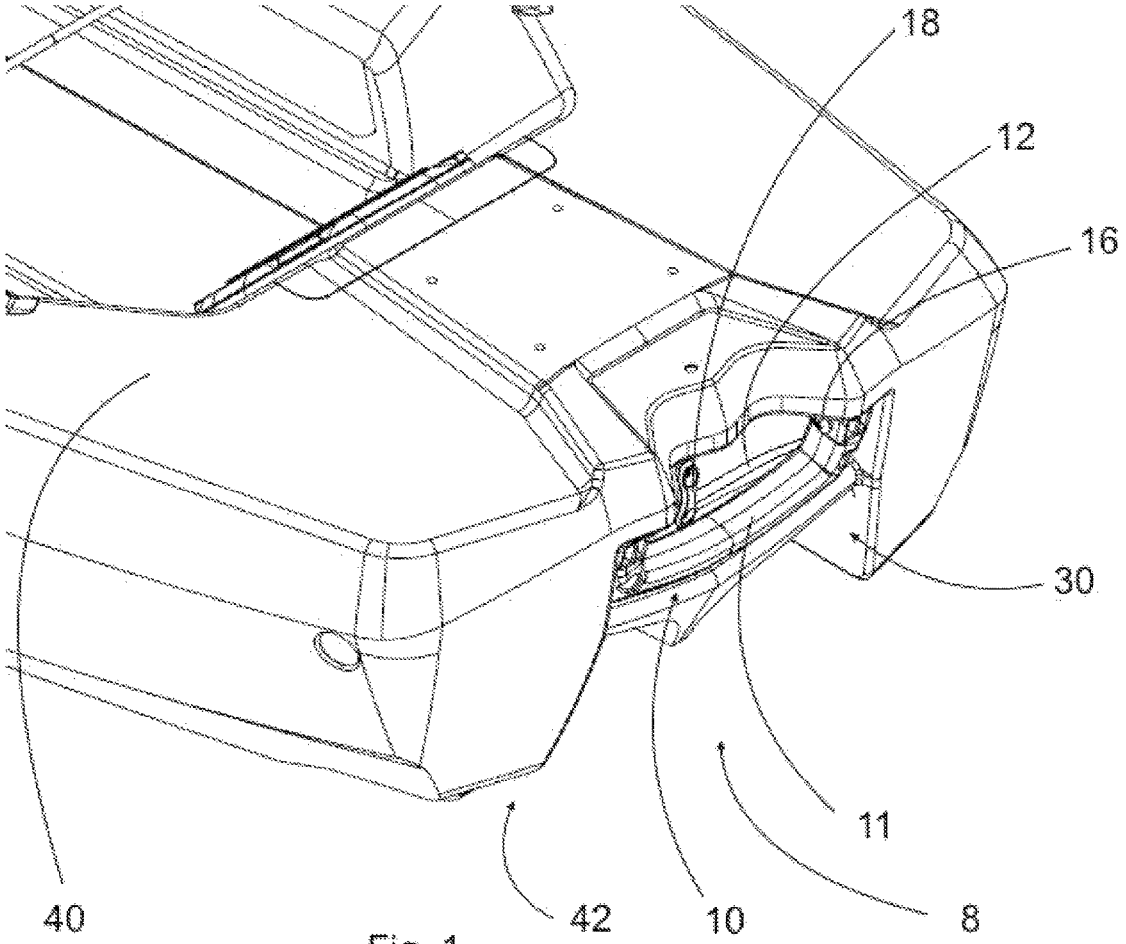
FIG. 1 is a partial rear perspective view of a watercraft showing a handle in a retracted position.
Figure 2:
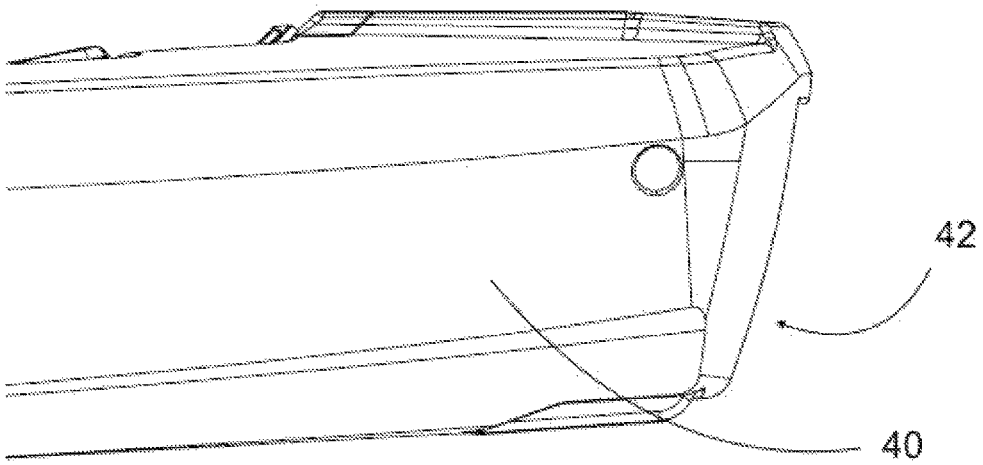
FIG. 2 is a partial side elevation view of the watercraft shown in FIG. 1.
Figure 3:
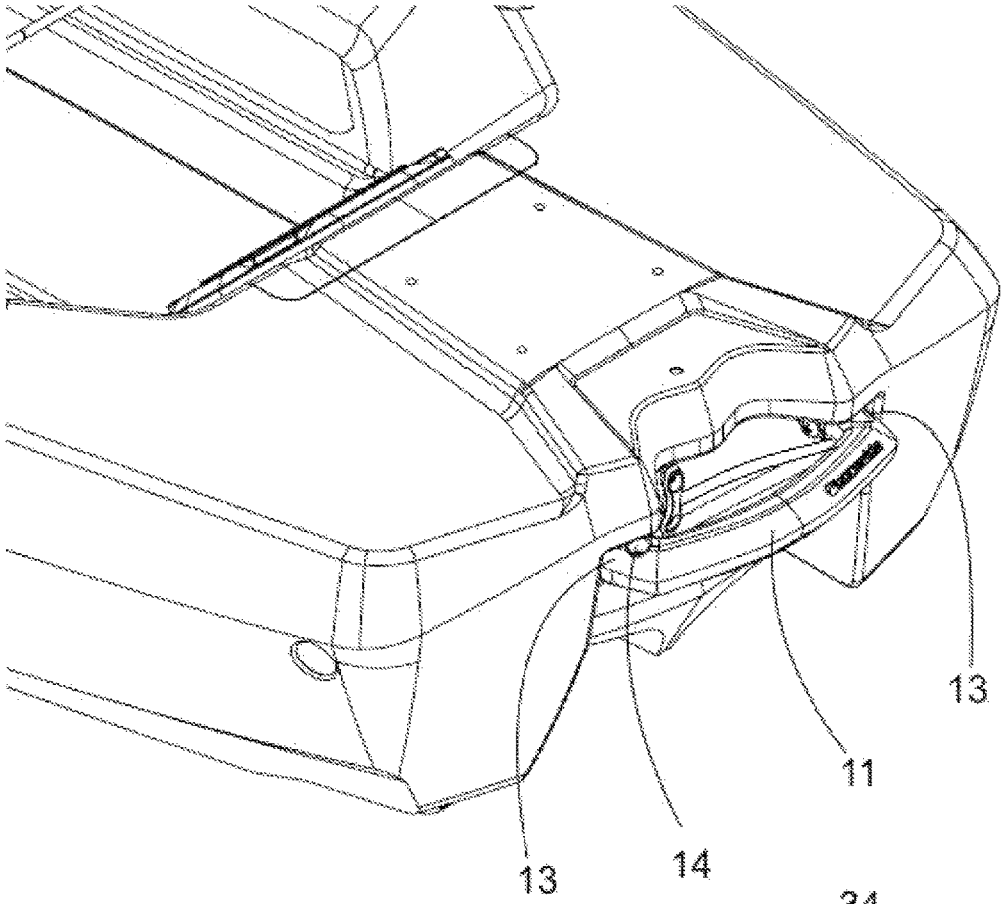
FIG. 3 is a partial rear perspective view of the watercraft showing the handle in an extended position.
Figure 4:
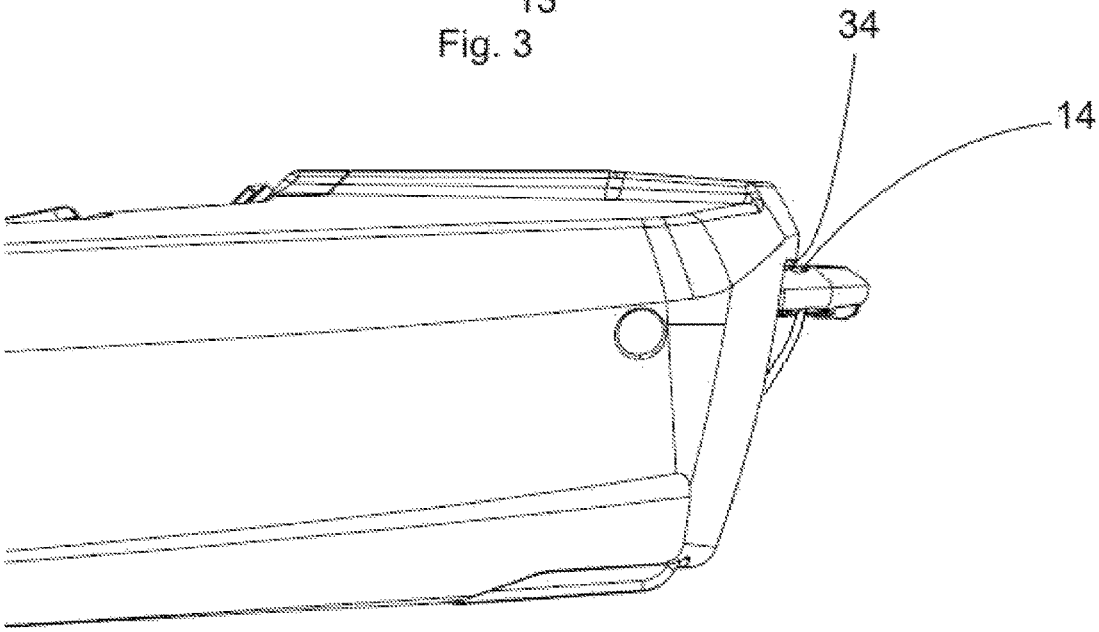
FIG. 4 is a partial side elevation view of the watercraft shown in FIG. 3.

It should be noted that orientational terms used throughout this description are with reference to the orientation of the handle and component parts thereof as presented in the accompanying drawings, which is subject to change. Therefore, orientational terms are used for semantic purposes, and do not limit the invention or its component parts in any particular way.

Referring now to the drawings, there is illustrated in FIGS. 1-6 an exemplary handle assembly 8 comprising a handle 10 connected in relation to a marine vessel or watercraft 40 within a housing 30 thereof. The housing 30 is at least partially defined, for example, by or within the body or hull of the watercraft 40, for example, at the stern 42 of the watercraft 40.

The exemplary handle 10 is operable to move between at least two positions, namely, a deployed position and a stowed position. The handle 10 may be located in the watercraft housing 30, wherein the handle 10 may be located within a profile of the watercraft 40, when the handle 10 is in a stowed or a retracted position, the retracted position being shown in FIG. 1. The handle 10 may be connected to the watercraft 40 in the watercraft housing 30 at pivots 16, so that the handle 10 is operable to rotate about the pivots 16 when the handle 10 is moved between extended and retracted positions.

The handle 10 may be comprised of a handle bar 11 having opposing sides and a handle end 13 on each side of the handle bar 11. The handle ends 13 may each have a fastener hole 26 through which a fastener 22 may be inserted and attached to the side 32 of the watercraft housing 30. Alternatively, the sides 32 of the watercraft housing 30 may each have a fastener hole 26 through which a fastener 22 may be inserted and attached to the handle ends 13. One or more spacers 24 may be first inserted into the fastener hole 26, through which the fastener 22 is then inserted and attached to the watercraft housing 30, allowing the handle 10 to be rotated freely about the pivots 16, the pivots 16 being defined by the fasteners 22 or about or along an axis defined by fasteners 22. The spacers 24 may mitigate resources consumed in the construction or formation of the handle 10 or housing 30, and thus lighten the handle 10, or alternatively, the handle ends 13 or housing sides 32 may be constructed or formed of a solid material.

The handle assembly 8 may further comprise a tether or cord 12. The handle 10 may be connected to the watercraft 40 by the cord 12, which may be an elastic cord, which may provide tension to the handle 10 when extended outwardly from the watercraft hull or housing 30 toward or to the deployed position. The cord 12 may include opposing ends. One end of the cord 12 may be threaded through, for example, a deck loop 18, or other suitable structure, which may be formed, connected or supported in relation to the watercraft hull or housing 30. The other end of the cord 12 may be threaded through a cord hole, channel or passage 14 supported in relation to at least one end 13 of the handle 10.

The cord 12 should be restricted from exiting back through the cord passage 14. For example, a knot could be tied in the cord 12 to restrict escapement through the cord passage 14.

Alternatively, the ends of the cord 12 may support or have connected thereto sleeve, crimp or clip fittings, or stop sleeves, or ball shank ends, or swage balls, for preventing passage of the cord 12 in relation the deck loop 18 and the cord passage, channel or hole 14 in the end 13 of the handle 10. It should be understood that the ends of the cords may be connected to the hull or housing 20 of the watercraft 40 and the handle 10 in any suitable manner, with any suitable fasteners, including threaded fasteners and washers, including, for example, cord or cable fasteners (e.g., threaded fasteners, rivets, etc.) and accompanying washers.

A user may move or extend the handle 10 by moving or pulling on the handle bar 11 in an upward and/or outward direction away from the watercraft hull or housing 30, preferably until the handle 10 contacts a stop for restricting movement of the handle 10 in relation to the hull or housing 30. The stop may be defined at least in part by an upper edge 34 of the hull or housing 30. For example, the handle 10 may rotate around the pivots 16 so that the cord 12 is placed under tension and exert force on the handle 10 to cause the handle 10 to move back towards or to the watercraft hull or housing 30. In accordance with this embodiment, when the user releases the handle 10, the tension in the cord 12 pulls the handle 10 and causes it to rotate back into a resting or stowed position within the watercraft hull or housing 30. Alternatively, the handle 10 may pulled in a direction away from the hull or housing 30, such as via a sliding motion, so that the cord 12 is placed under tension and exerts force on the handle 10 to cause the handle 10 to move back towards or to the watercraft hull or housing 30. In accordance with this embodiment, when the user releases the handle 10, the tension in the cord 12 pulls the handle 10 and causes it to move, or slide, back into the resting or stowed position within the watercraft hull or housing 30.

It should be appreciated that the handle 10 is intended to be supported in relation to the hull or housing 30 so that the watercraft 40 is substantially balanced, or that the weight of the watercraft 40 is substantially equally distributed or balanced when carried via the handle 10 so that the watercraft 40 does not tilt from one side to another.

It should also be appreciated that the movement of the handle is not necessarily intended to be a pivotal or sliding movement but may be any suitable movement for moving the handle 10 between the stowed and deployed positions.

It should be appreciated that the cord 12 may be a type of cord that provides tension when extended. For example, the cord 12 may be a bungee cord or similar type of cord.

Figure 5:
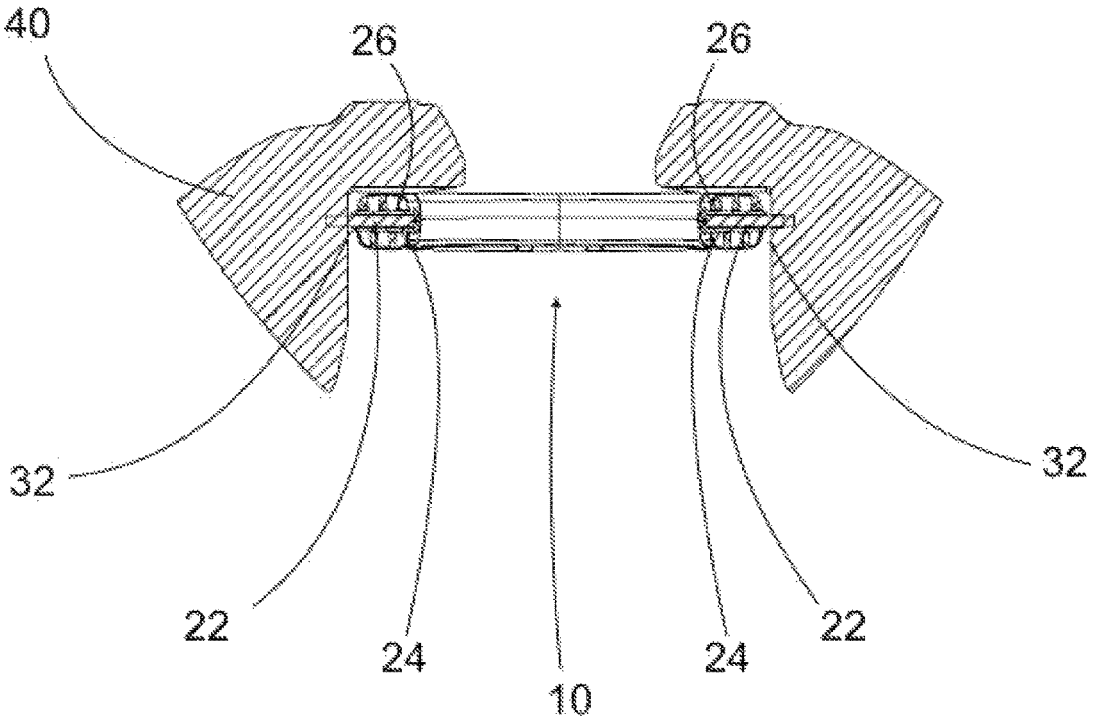
FIG. 5 is a sectional view of the handle and watercraft showing the handle in an extended position.
Figure 6:
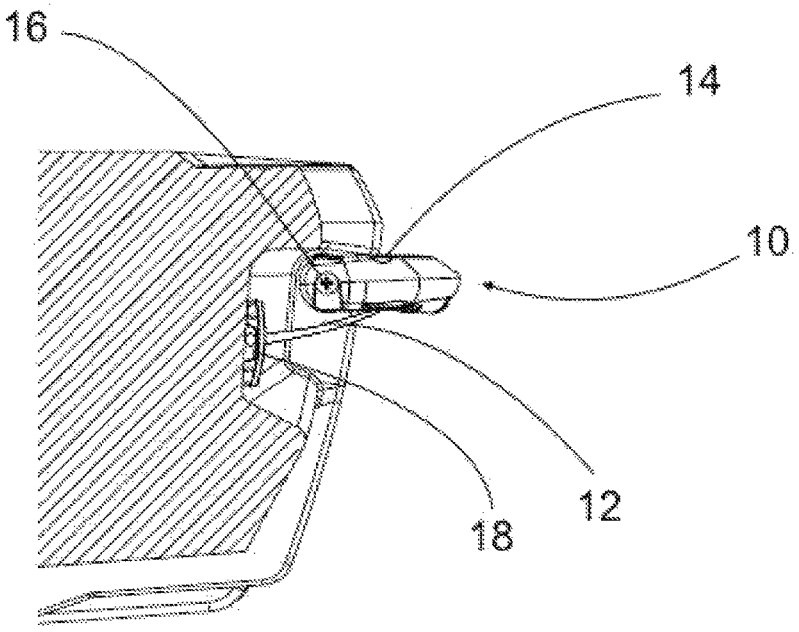
FIG. 6 is a side sectional view of the handle and watercraft showing the handle in an extended position.

It should be appreciated that the sectional views in FIGS. 5 and 6 show the watercraft 40 as being of solid construction for simplicity, and the watercraft 40 may instead be hollow or a combination of solid and hollow construction. It should also be appreciated that the handle 10 may be constructed from a lightweight material, such as plastic, carbon fiber, or composite material. Alternatively, the handle 10 may also be constructed from heavier materials, such as metal or wood, or in combination with a lightweight material. The handle 10 may also be of solid or hollow construction.

It should be appreciated that the handle 10 may be positioned in any number of locations on the watercraft 40. The handle 10 may be positioned at the stern 42 of the watercraft 40, but may also be positioned at the bow, on the sides or on top of the watercraft, or in a combination of any one of these positions.

It should be understood that the marine vessels or watercraft shown is shown for exemplary purposes and that the handle may be employed with other marine vessels or watercraft, or vessels or vehicles other than marine vessels or watercraft.

While the handle and components parts thereof may have been described herein in terms of certain components being referred to in either the singular or the plural, other arrangements are possible. For example, it is to be understood that due to the conceptual description presented herein, components presented in the singular may be provided in the plural, and vice versa.

In accordance with the provisions of the patent statutes, the principle and mode of operation of this invention have been explained and illustrated in its preferred embodiment. However, it must be understood that this invention may be practiced otherwise than as specifically explained and illustrated without departing from its spirit or scope.

What is claimed is:

1. A watercraft comprising:

a hull defining a profile, a handle connected in relation to the watercraft, the handle being operable to move between at least two positions comprising a deployed position and a stowed position, the handle being configured to extend away from the profile when the handle is moved to the deployed position and retract toward the profile when the handle is moved to the stowed position, the handle being structured to support at least a portion of the watercraft in a raised position when the handle is in the deployed position, and a cord connected between the handle and the hull.

2. The watercraft of claim 1, wherein the handle, when stowed, is within a housing, which is structured and dimensioned to be supported within the hull.

3. The watercraft of claim 1, wherein the handle is connected in relation to the watercraft at one or more pivots so that the handle is operable to rotate about the one or more pivots when the handle is moved between extended and retracted positions.

4. The watercraft of claim 1, further comprising a stop supported in relation to the hull for restricting movement of the handle in relation to the hull.

5. The watercraft of claim 4, wherein the stop is defined at least in part by an upper edge of the hull, wherein the user may extend the handle by pulling on the handle in an upward and outward direction away from the housing until the handle contacts the upper edge of the hull.

6. The watercraft of claim 5, wherein the hull at least partially defines opposing surfaces, and wherein the handle comprises:

a handle bar having opposing sides, and a handle end on each of the sides of the handle bar, and wherein one of the handle ends or the opposing surfaces of the hull each have a fastener hole through which a fastener is inserted and attached to the other one of the opposing surfaces or the handle ends.

7. The watercraft of claim 6, further comprising one or more spacers inserted into the fastener holes, through which the fasteners are inserted and attached, the one or more spacers being structured to promote free rotation of the handle about the pivots.

8. The watercraft of claim 1, wherein the handle is connected in relation to the hull so as to be slidable in relation to the hull, the handle being operable to slide between the extended position and the retracted position.

9. The watercraft of claim 1, further comprising a stop supported in relation to the hull for restricting movement of the handle in relation to the hull.

10. The watercraft of claim 1, wherein the cord is an elastic cord that provides tension to the handle when extended in relation to the hull to the deployed position for retracting the handle back to the stowed position.

11. The watercraft of claim 10, further comprising a deck loop supported in relation to the hull and a passage supported in relation to at least one end of the handle, the cord having opposing ends, one end of the cord being threaded through the deck loop, the other end of the cord being threaded through the passage, the ends of the cord being restricted from exiting through the deck loop and the passage.

12. The watercraft of claim 11, wherein the ends of the cord are restricted from exiting through the deck loop and the passage by a knot in each of the ends of the cord.

13. The watercraft of claim 11, wherein the ends of the cord are restricted from exiting through the deck loop and the passage by structure selected from sleeves, crimp or clip fittings, stop sleeves, ball shank ends, or swage balls.

14. The watercraft of claim 11, wherein the ends of the cord are restricted from exiting through the deck loop and the passage by cord fasteners and accompanying washers.

15. The watercraft of claim 1, wherein the cord comprises an elastic cord that is a bungee or similar type cord.

16. The watercraft of claim 1, wherein the handle is constructed from a lightweight material selected from a group of plastic, carbon fiber, or a composite material.

17. The watercraft of claim 1, wherein the hull has at least one of a stern, a bow or a side, and wherein the handle is connected in relation to one or more of the stern, the bow or the side.

18. The watercraft of claim 1, wherein the hull is structured and configured to form a stop for restricting movement of the handle in relation to the hull.

19. A watercraft comprising:

a hull defining a profile, a handle connected in relation to the watercraft, the handle being operable to move between at least two positions comprising a deployed position and a stowed position, the handle being configured to extend away from the profile when the handle is moved to the deployed position and retract toward the profile when the handle is moved to the stowed position, the handle being structured to support at least a portion of the watercraft in a raised position when the handle is in the deployed position, and a stop supported in relation to the hull for restricting movement of the handle in relation to the hull, wherein the stop is defined at least in part by an upper edge of the hull, wherein the user may extend the handle by pulling on the handle in an upward and outward direction away from the housing until the handle contacts the upper edge of the hull.

20. A watercraft comprising:

a hull defining a profile, a handle connected in relation to the watercraft, the handle being operable to move between at least two positions comprising a deployed position and a stowed position, the hull and the handle being cooperatively configured so that the handle is substantially within the profile of the hull when the handle is in the stowed position, the handle being configured to extend beyond the profile when the handle is moved to the deployed position and retract into the profile when the handle is moved to the stowed position, the handle being structured to support at least a portion of the watercraft in the raised position when the handle is in the deployed position and the handle is raised by a user, and a cord connected between the handle and the hull.

* * * * *